US007537411B2

(12) United States Patent
Yodock, Jr. et al.

(10) Patent No.: US 7,537,411 B2
(45) Date of Patent: May 26, 2009

(54) END CONNECTOR FOR BARRIER DEVICES

(76) Inventors: Leo J. Yodock, Jr., 44 Duke of Gloucester St., Bloomsburg, PA (US) 17815; Leo J. Yodock, III, 1775 Fifth St. Hollow Rd., Bloomsburg, PA (US) 17815; Guy C. Yodock, 5871 8 Point La., Lakeland, FL (US) 33811

( * ) Notice: Subject to any disclaimer, the term of this patent is extended or adjusted under 35 U.S.C. 154(b) by 206 days.

(21) Appl. No.: 11/750,543

(22) Filed: May 18, 2007

(65) Prior Publication Data

US 2008/0286041 A1 Nov. 20, 2008

(51) Int. Cl.
*E01F 13/02* (2006.01)

(52) U.S. Cl. ..... 404/6; 404/9; 256/13.1

(58) Field of Classification Search ..... 404/6, 404/9; 256/13.1
See application file for complete search history.

(56) References Cited

U.S. PATENT DOCUMENTS

| | | | |
|---|---|---|---|
| 3,326,099 | A | 6/1967 | Cova et al. |
| 3,606,258 | A | 9/1971 | Fitch |
| 3,698,290 | A | 10/1972 | Wallace |
| 3,704,861 | A | 12/1972 | Glaesener |
| 3,784,167 | A | 1/1974 | Glaesener |
| 3,856,268 | A | 12/1974 | Fitch |
| 3,876,185 | A | 4/1975 | Welch |
| 3,880,404 | A | 4/1975 | Fitch |
| 3,967,704 | A | 7/1976 | Ogden |
| 4,007,917 | A | 2/1977 | Brubaker |
| 4,059,362 | A | 11/1977 | Smith |
| 4,307,973 | A | 12/1981 | Glaesener |
| 4,321,989 | A | 3/1982 | Meinzer |
| 4,391,077 | A | 7/1983 | Giess |
| 4,415,680 | A | 11/1983 | Ushirokawa et al. |
| 4,681,302 | A | 7/1987 | Thompson |
| 4,773,629 | A | 9/1988 | Yodock et al. |
| 4,775,854 | A | 10/1988 | Cottrell |
| 4,869,619 | A | 9/1989 | Akesaka |
| 4,917,219 | A | 4/1990 | Henry |
| 4,946,306 | A | 8/1990 | Yodock et al. |
| 4,982,535 | A | 1/1991 | Pickett |
| 5,002,423 | A | 3/1991 | Mileti |
| 5,011,325 | A | 4/1991 | Antonioli |
| 5,046,884 | A | 9/1991 | Girotti |
| 5,052,850 | A | 10/1991 | Bishop |
| 5,104,254 | A | 4/1992 | Durand |
| 5,123,773 | A | 6/1992 | Yodock et al. |
| 5,429,448 | A | 7/1995 | Ballesteros |
| 5,498,101 | A | 3/1996 | Braverman |
| 5,531,540 | A | 7/1996 | Wasserstrom et al. |

(Continued)

FOREIGN PATENT DOCUMENTS

| | | | |
|---|---|---|---|
| FR | 631 582 | A1 | 11/1989 |

(Continued)

*Primary Examiner*—Raymond W Addie
(74) *Attorney, Agent, or Firm*—GrayRobinson, P.A.

(57) ABSTRACT

An end connector for a barrier device is provided which permits articulation of one barrier device through a relatively large angle with respect to an adjacent barrier device, so that a barrier wall may be formed of a plurality of barrier devices connected end-to-end having a significantly curved shape.

17 Claims, 2 Drawing Sheets

U.S. PATENT DOCUMENTS

| | | | |
|---|---|---|---|
| 5,605,413 | A | 2/1997 | Brown |
| 5,607,252 | A | 3/1997 | Tischer |
| 5,688,071 | A | 11/1997 | Owen |
| 5,882,140 | A | 3/1999 | Yodock et al. |
| 5,988,934 | A | 11/1999 | Wasserstrom |
| 6,082,926 | A | 7/2000 | Zimmer |
| 6,152,064 | A | 11/2000 | Morton |
| 6,179,516 | B1 | 1/2001 | Ivey et al. |
| 6,221,928 | B1 | 4/2001 | Kozma et al. |
| 6,666,616 | B2 | 12/2003 | Yodock, III et al. |
| 2002/0025221 | A1 | 2/2002 | Johnson |

FOREIGN PATENT DOCUMENTS

| | | | |
|---|---|---|---|
| GB | 2 292 404 | A | 2/1996 |

END CONNECTOR FOR BARRIER DEVICES

FIELD OF THE INVENTION

This invention relates to barrier devices for vehicular traffic control, soil erosion containment, impact attenuation and the like which can be interconnected with one another to define a barrier wall structure, and, more particularly, to an end connector for barrier devices which allows them to articulate relative to one another through an angle of about 22.5° in both the clockwise and counterclockwise directions when arranged in an interconnected line forming a barrier wall.

BACKGROUND OF THE INVENTION

A variety of different devices have been developed for absorbing the kinetic energy resulting from impact with a moving vehicle, and for the containment of forces exerted by soil or water. Highway barriers and channelizers, for example, are intended to provide a continuous wall or barrier along the center line or shoulder of a highway when laid end-to-end to absorb grazing blows from moving vehicles. One commonly used highway barrier is formed of pre-cast reinforced concrete, and is known as the "Jersey" style barrier. Highway barriers of this type have a relatively wide base resting on the pavement or shoulder of the highway, opposed side walls and opposed end walls. The side walls consist of a "curb reveal" extending vertically upwardly from the base a short distance, a vertically extending top portion connected to the top wall of the barrier and an angled portion between the curb reveal and the vertical top portion. This design is intended to contact and redirect the wheels of a vehicle in a direction toward the lane of traffic in which the vehicle was originally traveling, instead of the lane of opposing traffic. See, for example, U.S. Pat. No. 4,059,362.

One problem with the Jersey-style highway barriers described above is the weight of reinforced concrete. A concrete barrier having a typical length of twelve feet weighs about 2,800-3,200 pounds, and requires special equipment to load, unload and handle on site. It has been estimated that for some road repairs, up to 40 percent of the total cost is expended on acquiring, delivering and handling concrete barriers. Additionally, concrete barriers have little or no ability to absorb shock upon impact, and have a high friction factor. This increases the damage to vehicles which collide with such barriers, and can lead to serious injuries to passengers of the vehicle.

In an effort to reduce weight, facilitate handling and shipment, and provide improved absorption of vehicle impact forces, highway barriers have been designed which are formed of a hollow plastic container filled with water, sand or other ballast material such as disclosed in U.S. Pat. Nos. 4,681,302, 4,773,629, 4,946,306, 5,123,773 and 5,882,140. For example, the '302 patent discloses a barrier comprising a housing having a top wall, bottom wall, opposed side walls and opposed end walls interconnected to form a hollow interior which is filled with water. The ends of each barrier couple to an adjacent barrier to form a continuous wall. The container structure is preferably formed of a resilient, plastic material which is deformable upon impact and capable of resuming its original shape after being struck.

The '629, '306, '773 and '140 patents noted above represent advances in deformable highway barrier designs. The first two patents disclose barriers which comprise a longitudinally extending housing made of semi-rigid plastic which is self-supporting, and has a predetermined shape which is maintained when filled with water, sand or other ballast material. Such devices are connected end-to-end by a key insertable within grooves formed in the end walls of adjacent barriers. Interconnected fill openings are provided which permit adjacent barriers to be filled with water or other ballast material when laid end-to-end.

The '773 and '140 patents disclose further improvements in barrier devices including side walls formed with higher curb reveals, a horizontally extending step and vertical indentations in order to assist in maintaining the structural integrity of the container, and internal baffles for dampening movement of water or other ballast material within the container interior. Interlocking male and female coupling elements are formed on the opposite end walls of each barrier to facilitate connection of adjacent barriers end-to-end. Additionally, channels or openings are formed in the barriers from one side wall to the other to permit the insertion of the tines of a fork lift truck therein for easy loading, unloading and handling of the barriers.

One problem with barrier devices of the type described above is that the coupling elements which connect one barrier device to an adjacent one permit limited pivotal movement. While a gradual curve along a barrier wall formed by a number of interconnected barrier devices may be obtained, the amount of articulation between adjacent barriers is limited to a few degrees. Consequently, such barrier devices may not be used on roadways or other applications with sharper curves.

SUMMARY OF THE INVENTION

This invention is directed to an end connector for a barrier or channelizer device which permits articulation of one barrier device through a relatively large angle with respect to an adjacent barrier device within a barrier wall, so that a barrier wall may be formed having a significantly curved shape.

The barrier device of this invention comprises a housing having a top wall, a bottom wall, opposed end walls and opposed side walls interconnected to form a hollow interior adapted to be at least partially filled with a ballast material. In the presently preferred embodiment, the end connector of each barrier device includes a first coupling element on one end wall and a second coupling element on the opposite end wall, both of which extend from the top wall of the barrier device to its bottom wall. The first coupling element has a generally cylindrical-shaped inner cavity, defined by a curved surface on the end wall, a portion of which is open. An arm extends from opposite sides of the opening in the inner cavity. Each arm forms a stop along its inner surface, and a convex pivot surface along its outer surface. The two stops are spaced approximately 45° from one another.

The second coupling element on the opposite end wall of each barrier device includes a neck section protruding outwardly from a concave pivot surface formed on such opposite end wall between the top and bottom walls of the barrier device. The neck section is connected to a cylindrical-shaped pivot pin. In forming a barrier wall with the barrier devices of this invention, the pivot pin of the second coupling element of one barrier device is inserted into the inner cavity of the first coupling element of an adjacent barrier. The pivot pin is captured within the inner cavity, and the neck portion of the second coupling element extends between the two arms of the first coupling element. Because the two arms of the first coupling element are spaced about 45° apart, the barrier with the second coupling element can pivot throughout essentially the same 45° angle relative to the adjacent barrier, e.g. approximately 22.5° in both the clockwise and counterclockwise direction. This permits a barrier wall to be formed having a substantial curve, compared to that permitted in prior barrier device designs, allowing the barrier devices herein to be used on most curved roadways and similar applications.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 3:
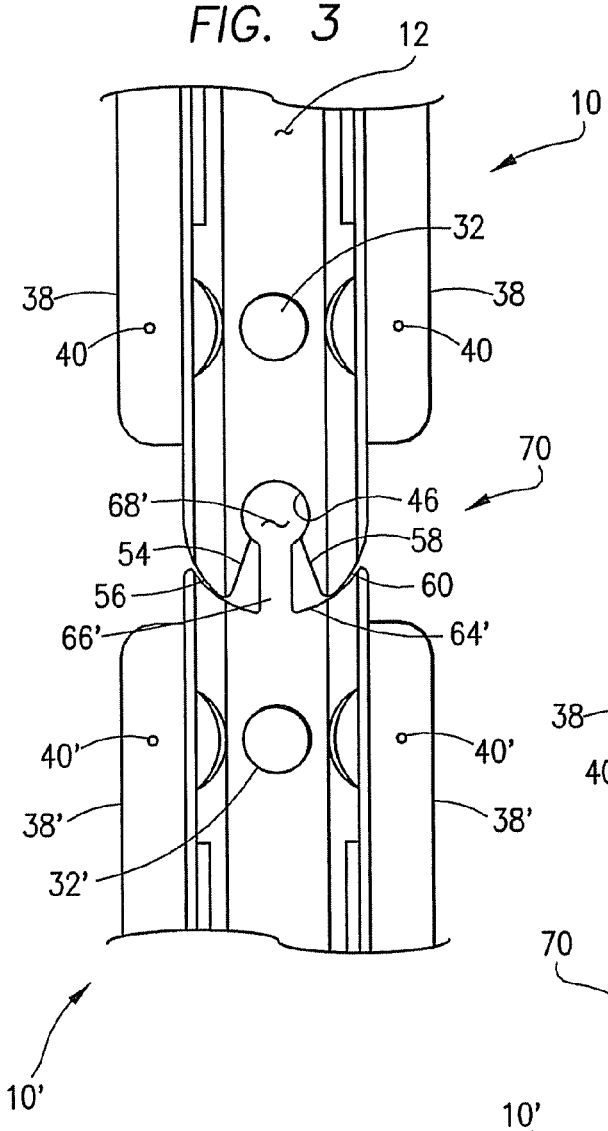
FIG. 3 is a partial plan view of one barrier device connected to an adjacent barrier device, with the two barrier devices aligning with one another.
Figure 4:
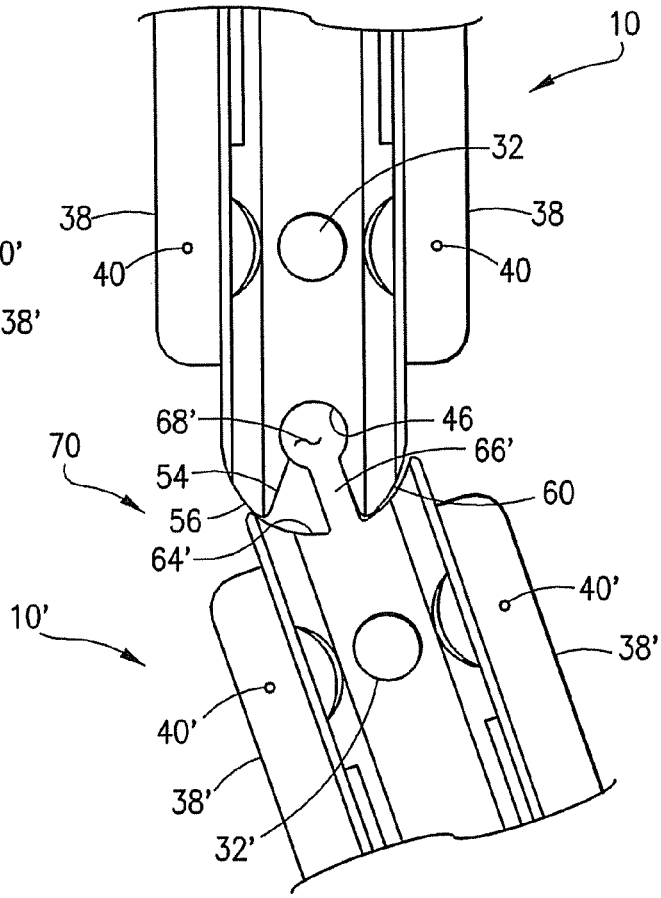
FIG. 4 is a view similar to FIG. 3 except with the two barrier devices pivoted relative to one another.

Referring now to the Figs., the barrier device 10 of this invention comprises a top wall 12, a bottom wall 14, opposed end walls 16, 18, and, opposed side walls 20, 22 which are interconnected to collectively define a hollow interior. A number of barrier devices 10 may be arranged end-to-end to form an essentially continuous wall. Two barrier devices 10, 10' are shown in FIGS. 3 and 4 which are identical in structure and function, and therefore the same reference numbers are used to identify like structures with the addition of a "'" to the numbers associated with the barrier 10'.

In the presently preferred embodiment, each of the walls 12-22 are formed of a semi-rigid plastic material chosen from the group consisting of low density polyethylene, acrylonitrile or butadiene styrene, high impact styrene, polycarbonates and the like. These plastic materials are all inherently tough and exhibit good energy absorption characteristics. They will also deform and elongate, but will not fail in a brittle manner at energy inputs which cause other materials to undergo brittle failure. The surfaces of these types of plastic materials are inherently smoother than materials from which other barriers are typically constructed, therefore creating less friction and reducing the likelihood of serious abrasion injuries to vehicles and/or passengers who may come into contact therewith. Additionally, materials of this type are unaffected by weather and have excellent basic resistance to weathering, leaching and biodegradation. Additives such as ultraviolet inhibitors can be combined with such plastic materials making them further resistant to the effects of weather. They also retain their mechanical and chemical properties at low ambient temperatures.

When using the barrier device 10 of this invention as a highway barrier, the hollow interior is preferably filled with a "ballast" material such as water or other liquid, or a flowable solid material such as sand, concrete and the like. For this purpose, the walls 12-22 of barrier device 10 have a thickness in the range of about one-eighth inch to one inch so as to perform satisfactorily in service. The barrier device 10 is preferably in the range of about six to eight feet in length, and, at the wall thickness noted above, has a weight when empty of about 20 to 140 lbs. When filled with a liquid such as water, the overall weight of the barrier is in the range of about 150 to 2,200 lbs. Flowable solid material such as sand and the like increase the weight of barrier 10 further.

The side walls 20 and 22 each include a substantially vertically oriented curb reveal 26 located between the bottom wall 14 and a horizontally extending ledge or step 28. Extending upwardly at an acute angle from the step 28 is an intermediate section 30 which terminates at the top wall 12. The top wall 12 of barrier 10 is formed with a pair of fill holes 32, preferably having a diameter in the range of about 3-4 inches, through which ballast material may be poured into the hollow interior of the barrier 10. In the presently preferred embodiment, a number of stabilizers 34 are integrally formed in the intermediate section 30, at regularly spaced intervals between the end walls 16, 18. Openings 36 extend through the barrier device 10, between the side walls 20 and 22, which are sized to receive the tines of a fork lift truck in order to move the barrier device 10 from place to place. A stabilizing plate 38 may be connected to the curb reveal 26 of each side wall 20 and 22 to enhance the lateral stability of the barrier device 10. The plates 38 may be formed with one or more holes 40 through which stakes or bolts (not shown) may be inserted and driven into the ground, highway or other surface to provide additional stability.

Figure 1:
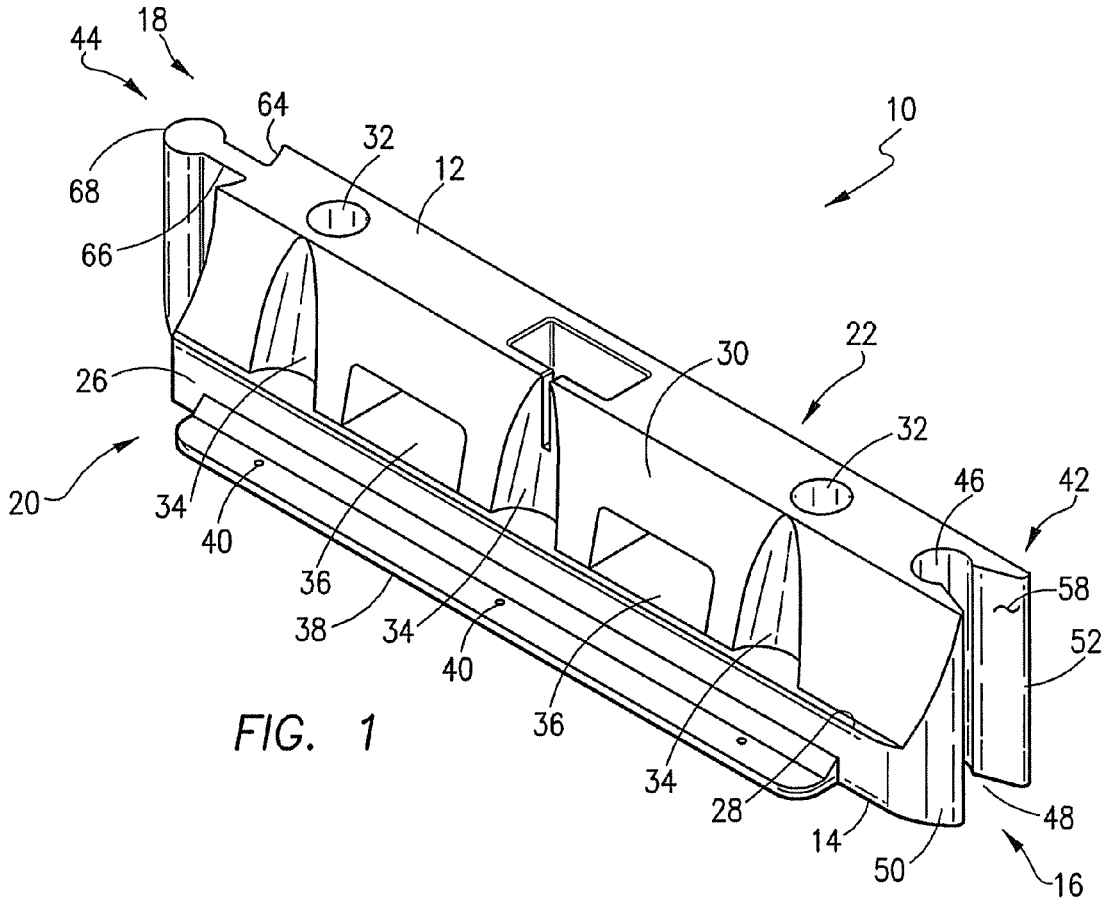
FIG. 1 is a perspective view of a barrier device having the end connector of this invention.
Figure 2:
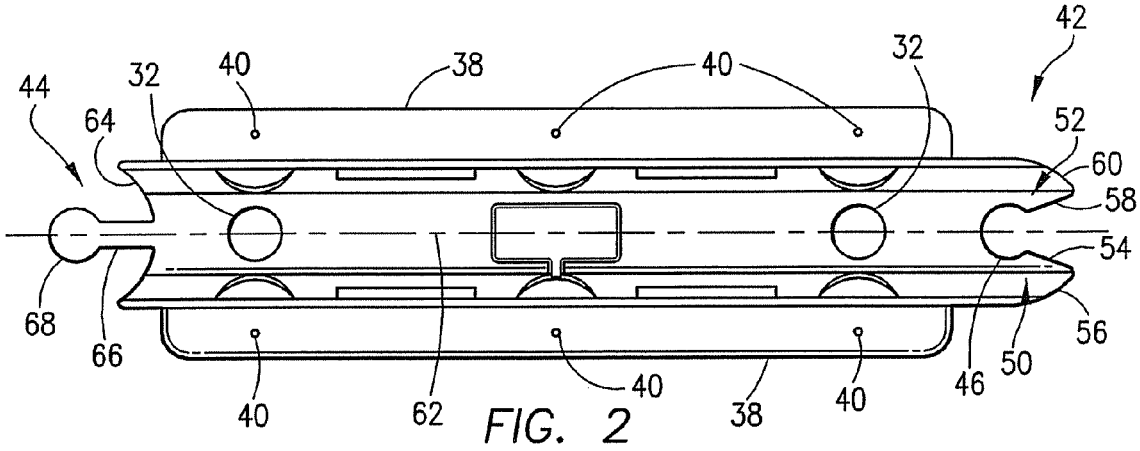
FIG. 2 is a plan view of the barrier device shown in FIG. 1.

In the presently preferred embodiment, the end wall 16 is formed with a first coupling element 42 and the end wall 18 is formed with a second coupling element 44 which permit articulation of one barrier device 10 relative to a second barrier device 10' as discussed below. The first and second coupling elements 42 and 44 extend from the top wall 12 to the bottom wall 14 of the barrier device 10. The first coupling element 42 comprises an inner cavity 46 defined by an arcuate surface of the end wall 16 having the general shape of a portion of a cylinder. The inner cavity 46 is formed with an outwardly facing opening 48 which is bounded on one side by a first arm 50 and on the opposite side by a second arm 52. The first arm 50 includes an angled inner surface forming a stop 54, and an outer portion defining a convex pivot surface 56. The second arm 52 has the same construction, with a stop 58 and convex pivot surface 60. As best seen in FIG. 2, the surfaces forming the stops 54 and 58 of the arms 50 and 52 are spaced from one another and oriented at an angle relative to the longitudinal axis 62 of the barrier device 10. The angle formed by each stop 54 and 58 with the longitudinal axis 62 is preferably on the order of about 22.5° thus defining an overall angle between the stops 54 and 58 of about 45°. As such, the angular extent of the inner cavity 46 is approximately 315°.

The second coupling element 44 formed on the end wall 18 comprises a concave surface 64 extending from the top wall 12 to the bottom wall 14 of the barrier device 10, and between its side walls 20 and 22. A thin, generally rectangular-shaped neck section 66 protrudes outwardly from the concave surface 64, along its entire length. The neck section 66 is connected to a generally cylindrical-shaped pivot pin 68.

Referring now to FIGS. 3 and 4, in order to form a barrier wall 70 of a number of barrier devices 10, 10', the inner cavity 46 of the first coupling element 42 receives the pivot pin 68' of the second coupling element 44' of an adjacent barrier device 10' such that the neck portion 66' of the second coupling element 44' extends between the first and second arms 50, 52 of the first coupling element 42. The pivot pin 68' has a larger diameter than the width of the opening 48 between the arms 50 and 52 of first coupling element 42, and must be inserted into the inner cavity 46 from the top wall 12 toward the bottom wall 14, or vice versa. This ensures that the two barrier devices 10 and 10', once connected, do not disengage from one another.

As depicted in FIG. 3, when adjacent barriers 10 and 10' are connected together, the convex pivot surfaces 56 and 60 of respective arms 50 and 52 of the first coupling element 42 bear against the concave surface 64' of the second coupling element 44'. The neck section 66' of the second coupling element 44' has sufficient length so that it extends somewhat beyond the opening 48 of the inner cavity 46. The barriers 10 and 10' are pivotal relative to one another along their cooperating pivot surfaces 56, 60 and 64', respectively, in either the clockwise or counterclockwise direction, until the neck section 66' of the second coupling element 44' of barrier device 10' engages the stop 54 or stop 58 of the first coupling element 42 of barrier device 10. The barrier devices 10, 10' may travel through an angle relative to one another of somewhat less than the 45° spacing between the stops 54', 58' due to the thickness of the neck section 66, e.g. about 22.5° in both the clockwise and counterclockwise directions, but such extent of articulation is far superior than barrier devices currently commercially available. As a result, the overall barrier wall 70 formed by alternating barrier devices 10 and 10' can assume a comparatively sharp curve when positioned along a roadway or the like.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A barrier device, comprising:

a top wall, a bottom wall, first and second side walls and first and second end walls interconnected to collectively define a hollow interior adapted to be at least partially filled with a ballast material, a longitudinal axis extending between said opposed end walls;

said first end wall being formed with a first coupling element extending from said top wall to said bottom wall, said first coupling element comprising:

(i) an inner cavity defined by a curved surface of said first end wall and having opposed ends which are spaced from one another;

(ii) a first arm extending from one end of said inner cavity, said first arm being formed with a pivot surface and a stop surface;

(iii) a second arm extending from the other end of said inner cavity and being spaced from said first arm, said second arm being formed with a pivot surface and a stop surface;

said second end wall being formed with a second coupling element extending from said top wall to said bottom wall, said second coupling element comprising:

(i) a concave pivot surface extending from said first side wall to said second side wall;

(ii) a neck protruding outwardly from said concave pivot surface and terminating with a pivot pin.

2. The barrier device of claim 1 in which said curved surface of said inner cavity of said first coupling elements extends through an angle of about 315°.

3. The barrier device of claim 1 in which said stop surface of said first arm of said first cavity is oriented at an angle of about 22.5° relative to said longitudinal axis.

4. The barrier device of claim 1 in which said stop surface of said second arm of said first cavity is oriented at an angle of about 22.5° relative to said longitudinal axis.

5. The barrier device of claim 1 in which said pivot surface of each of said first and second arms is convex in shape.

6. The barrier device of claim 1 in which said neck of said first coupling element is generally rectangular in shape.

7. The barrier device of claim 6 in which said pivot pin is generally cylindrical in shape.

8. A barrier wall, comprising:

a number of individual barrier devices each having a top wall, a bottom wall, first and second side walls and first and second end walls interconnected to collectively define a hollow interior adapted to be at least partially filled with a ballast material, a longitudinal axis extending between said opposed end walls;

said first end wall of each barrier device being formed with a first coupling element extending from said top wall to said bottom wall, said first coupling element comprising:

(i) an inner cavity defined by a curved surface of said first end wall and having opposed ends which are spaced from one another;

(ii) a first arm extending from one end of said inner cavity, said first arm being formed with a pivot surface and a stop surface;

(iii) a second arm extending from the other end of said inner cavity and being spaced from said first arm, said second arm being formed with a pivot surface and a stop surface;

said second end wall of each barrier device being formed with a second coupling element extending from said top wall to said bottom wall, said second coupling element comprising:

(i) a concave pivot surface extending from said first side wall to said second side wall;

(ii) a neck protruding outwardly from said concave pivot surface and terminating at a pivot pin;

said pivot pin of said second coupling element of one barrier device being insertable within said inner cavity of said first coupling element of an adjacent barrier device so that said pivot surface of each of said first and second arms of said first coupling element engages and pivots along said concave pivot surface of said second coupling element through an angle defined by the spacing between said first and second arms.

9. The barrier wall of claim 8 in which said curved surface of said inner cavity of said first coupling element of each barrier device extends through an angle of about 315°.

10. The barrier wall of claim 8 in which said stop surface of said first arm of said first cavity in each barrier device is oriented at an angle of about 22.5° relative to said longitudinal axis.

11. The barrier device of claim 8 in which said stop surface of said second arm of said first cavity in each barrier device is oriented at an angle of about 22.5° relative to said longitudinal axis.

12. The barrier wall of claim 8 in which said pivot surface of each of said first and second arms of each barrier device is convex in shape.

13. The barrier wall of claim 8 in which said neck of said first coupling element of each barrier device is generally rectangular in shape and extends between said convex pivot surface and said pivot pin.

14. The barrier wall of claim 13 in which said pivot pin of each barrier device is generally cylindrical in shape.

15. The barrier wall of claim 13 in which said neck of said second coupling element of one barrier device engages said stop surface of said first arm and said stop surface of said second arm of said first coupling element of an adjacent barrier device in the course of pivotal movement of said barrier devices relative to one another.

16. The barrier wall of claim 15 in which said stop surfaces of said first and second arms of said first coupling element of said adjacent barrier device are spaced from one another to permit articulation of said one barrier device relative to said adjacent barrier device through an angle of about 45°.

17. The barrier wall of claim 15 in which said stop surfaces of said first and second arms of said first coupling element of said adjacent barrier device are spaced from one another to permit articulation of said one barrier device relative to said adjacent barrier device through an angle of about 22.5° in the clockwise direction and about 22.5° in the counterclockwise direction.

* * * * *